US008312831B2

(12) United States Patent
Templeman et al.

(10) Patent No.: US 8,312,831 B2
(45) Date of Patent: Nov. 20, 2012

(54) HYDROFOIL BOAT STABILIZER

(75) Inventors: Jon Templeman, Lenexa, KS (US); Wayne Becker, Wichita, KS (US)

(73) Assignee: Marine Dynamics, Inc., Lenexa, KS (US)

( * ) Notice: Subject to any disclaimer, the term of this patent is extended or adjusted under 35 U.S.C. 154(b) by 148 days.

(21) Appl. No.: 12/826,412

(22) Filed: Jun. 29, 2010

(65) Prior Publication Data

US 2011/0315063 A1 Dec. 29, 2011

(51) Int. Cl.
*B63B 1/24* (2006.01)

(52) U.S. Cl. ..... 114/274; 440/66

(58) Field of Classification Search ..... 114/274, 114/280; 440/66
See application file for complete search history.

(56) References Cited

U.S. PATENT DOCUMENTS

| | | | | |
|---|---|---|---|---|
| 2,021,309 | A | 11/1935 | Irgens | |
| 2,319,640 | A | 5/1943 | Sink | |
| 2,963,000 | A | 12/1960 | Fester | |
| 2,998,795 | A | 9/1961 | Downie et al. | |
| 3,099,240 | A | 7/1963 | Montague, Jr. | |
| 3,114,343 | A | 12/1963 | Headrick et al. | |
| 3,139,853 | A | 7/1964 | McCarthy et al. | |
| 3,211,119 | A | 10/1965 | Kiekhaefer | |
| 3,270,101 | A | 8/1966 | Jardine et al. | |
| 3,343,512 | A | 9/1967 | Rasmussen | |
| 3,433,195 | A * | 3/1969 | Poole | 114/274 |
| 3,765,356 | A | 10/1973 | Cook | |
| 3,964,417 | A | 6/1976 | Williams et al. | |
| 4,034,696 | A | 7/1977 | Kureth | |
| 4,040,373 | A | 8/1977 | Jones, Jr. | |
| 4,205,618 | A | 6/1980 | Olsson | |
| 4,304,557 | A | 12/1981 | Henrich | |
| 4,323,355 | A | 4/1982 | Kondo | |
| 4,352,666 | A | 10/1982 | McGowan | |
| 4,377,123 | A | 3/1983 | Jackson | |
| 4,381,725 | A | 5/1983 | Rowan | |
| 4,487,152 | A * | 12/1984 | Larson | 114/274 |
| 4,519,336 | A | 5/1985 | Mason | |
| 4,597,742 | A | 7/1986 | Finkl | |
| 4,676,181 | A | 6/1987 | Oates, Jr. | |
| 4,708,672 | A | 11/1987 | Bentz et al. | |

(Continued)

FOREIGN PATENT DOCUMENTS

| | | |
|---|---|---|
| GB | 716879 | 10/1954 |

(Continued)

OTHER PUBLICATIONS

Mechanical Engineering, THILMANY, Jean, Swim Like the Sharks, 3 pp., May 2004, www.memagazine.org/backissues/membersonly/may04/departments/input_output.html.

(Continued)

*Primary Examiner* — Stephen Avila
(74) *Attorney, Agent, or Firm* — McAfee & Taft

(57) ABSTRACT

A hydrofoil boat stabilizer having a cross-sectional area with the configuration of a true hydrofoil is provided. The hydrofoil includes a slip-on yoke designed to compressively fit on a cavitation plate of a boat motor lower drive unit. The wings of the hydrofoil include at least one angle of attack, and preferably, a plurality of angles of attack. The hydrofoil is shaped to reduced drag and minimize cavitation. A low-drag surface is included on at least a portion of the outer surface of the hydrofoil.

41 Claims, 13 Drawing Sheets

U.S. PATENT DOCUMENTS

| | | | | |
|---|---|---|---|---|
| 4,738,644 | A | 4/1988 | Happel | |
| 4,744,779 | A | 5/1988 | Koehler | |
| 4,748,927 | A | 6/1988 | Bujacich | |
| 4,750,448 | A | 6/1988 | Hennebutte | |
| 4,756,265 | A | 7/1988 | Lane | |
| D308,851 | S | 6/1990 | Templeman | |
| D311,513 | S | 10/1990 | Templeman | |
| 4,967,682 | A | 11/1990 | O'Donnell | |
| 4,968,275 | A | 11/1990 | Carlson | |
| 4,977,847 | A | 12/1990 | Bartlett | |
| 5,048,449 | A | 9/1991 | Templeman | |
| 5,105,756 | A | 4/1992 | Bell | |
| 5,107,786 | A | 4/1992 | Templeman | |
| D331,738 | S | 12/1992 | Simpson | |
| 5,203,275 | A | 4/1993 | Brauner et al. | |
| 5,231,950 | A | 8/1993 | Poulos | |
| D351,129 | S | 10/1994 | Templeman | |
| D352,023 | S | 11/1994 | Corn | |
| D363,914 | S | 11/1995 | Corn | |
| 5,516,315 | A * | 5/1996 | Griffin | 440/66 |
| 5,551,369 | A * | 9/1996 | Shen | 114/274 |
| 5,819,678 | A | 10/1998 | Austin | |
| 5,839,386 | A | 11/1998 | Frieling et al. | |
| 6,199,498 | B1 | 3/2001 | Hundertmark et al. | |
| 6,446,264 | B2 | 9/2002 | Fairhurst et al. | |
| 6,659,032 | B1 | 12/2003 | Simon | |
| 6,928,949 | B1 | 8/2005 | Simon | |
| 6,973,847 | B2 | 12/2005 | Adams et al. | |
| 7,004,101 | B1 | 2/2006 | Mardikian | |
| 7,021,232 | B2 | 4/2006 | Chen | |
| 7,101,240 | B2 | 9/2006 | McCarthy | |
| 7,115,007 | B2 | 10/2006 | Dulger | |
| D533,497 | S | 12/2006 | Templeman | |
| D589,866 | S | 4/2009 | Templeman et al. | |
| D590,760 | S | 4/2009 | Templeman et al. | |
| 2005/0076819 | A1 * | 4/2005 | Hilleman | 114/67 R |
| 2007/0022510 | A1 | 2/2007 | Chapuis et al. | |
| 2009/0314195 | A1 * | 12/2009 | Templeman et al. | 114/274 |

FOREIGN PATENT DOCUMENTS

| | | |
|---|---|---|
| SE | 226596 | 5/1969 |
| WO | WO 2007/047257 A1 | 4/2007 |

OTHER PUBLICATIONS

Unknown, Joyce, Luke, Project Proposal and Feasibility Study, 29 pp. Dec. 9, 2005, place of publication unknown.

Unknown, Joyce, Luke, Senior Design 2006 Team 9: Boat! Final report, 47 pp. May 12, 2006, place of publication unknown.

The 15th Chesapeake Sailing Yacht Symposium, Speer, Thomas E., The Basiliscus Project—Return of the Cruising Hydrofoil Sailboat, 22 pp., admitted prior art, place of publication unknown , Apr. 2001.

* cited by examiner

HYDROFOIL BOAT STABILIZER

BACKGROUND

The present invention relates to a hydrofoil boat stabilizer having a true lifting airfoil/hydrofoil shape incorporated into the design, which provides lift to the stern of the boat. The hydrofoil boat stabilizer is attachable to a cavitation plate on the lower drive unit of a boat motor.

The skilled artisan understands that the drive system of a boat generates the forward thrust. The same skilled artisan also understands that the boat and drive system are fighting the forces of drag upon the boat as it rides low in the water. Thus, the higher in the water, or "on the plane," a boat rides, the less drag it encounters. Therefore, it is desirable to reduce the amount of boat drag.

Boats inherently have drag from many sources, and one way to reduce drag is to get the boat on the plane faster by providing lift to the lower drive unit with a boat stabilizer. Unfortunately, while providing lift and reducing drag on the boat, these same stabilizers also introduce additional drag, limiting the overall performance of the boat and motor.

In their attempt to manage water flow, the designers of the known boat stabilizers inadvertently introduce one or more points of cavitation in and around the stabilizer by choosing a design that is not a true hydrofoil shape, or by choosing the wrong true hydrofoil shape for the application. As the speed of the boat varies, the position of the cavitating water changes location on the stabilizer and often increases in magnitude. Cavitation is the rapid formation and collapse of vapor pockets in moving water in regions of very low pressure. Accordingly, cavitation is controlled on the hydrofoil by keeping the maximum velocity that occurs on the hydrofoil below the limit at which cavitation occurs, or has significant effect. This cavitation of the water introduces significant levels of drag.

It is desirable to have the "right" true hydrofoil shape for a boat stabilizer. A true hydrofoil shape is a hydrofoil designed and tested by using aerodynamic/hydrodynamic design principles and procedures, such as the foil design software, XFOIL Subsonic Airfoil Development System, from the Massachusetts Institute of Technology, or a similar such program. A true hydrofoil shape improves performance, and reduces both cavitation and drag. Various hydrofoil designers have produced and tested several true hydrofoil shapes, each having different performance characteristics across a wide range of performance parameters at differing speeds, to include lift, drag, profile drag, cavitation, and laminar-to-turbulent transition. Some non-limiting examples of hydrofoil shapes include the NACA 63-209, Eppler E817, Eppler E818, Eppler E836, Eppler 837, Eppler E838, Eppler E874, Eppler E904, Eppler E908, and the Speers H105. The "right" true hydrofoil shape is one that is applicable for the particular performance characteristics desired for the boat, engine and boat stabilizer. For example, a performance characteristic might be a constant, total laminar flow across the entire hydrofoil wing section for a given speed range.

Hydrofoil lift characteristics are balanced against drag and cavitation resistance for given speeds. Preferably, the hydrofoil will control cavitation across a broad range of speeds/velocities. One example of hydrofoil performance is the H105 hydrofoil shape, which has a profile drag that is nearly constant as the laminar-to-turbulent transition point moves forward on the upper surface of the hydrofoil. Simultaneously, the laminar-to-turbulent transition point moves aft on the lower surface as flow speed increases. This results in the example H105 hydrofoil maintaining nearly the same total amount of laminar flow across it, thereby providing strong lift characteristics. By maintaining a constant laminar flow, the rapid formation and collapse of vapor pockets along the hydrofoil are reduced to a constant level, thereby reducing the opportunity for creation of additional drag due to cavitation.

A need exists for a boat stabilizer that has a true hydrofoil shape, low-drag and minimizes cavitation on and around it. Additionally, a need exists for a hydrofoil boat stabilizer that provides good lift characteristics to minimize drag and cavitation.

SUMMARY

In accordance with the present invention, a hydrofoil boat stabilizer is provided which overcomes the deficiencies described above and has other advantages as well.

In one embodiment, the current invention provides a slip-on hydrofoil, The slip-on hydrofoil comprises a yoke and a pair of wings. The yoke includes a center body defining a longitudinal channel therein. The longitudinal channel has a first and second side, and is open to the front of the center body. The yoke also includes a pair of open-ended slots oppositely disposed in each of the channel sides, and extending along a substantial length of the sides. The open-ended slots are capable of receiving a cavitation plate of a boat motor. The yoke includes a tail section that is integrally formed with the center body. The tail section covers a portion of the longitudinal channel. The yoke includes a contoured trailing edge defined by the tail section. The contoured trailing edge angles upwardly. The pair of wings are integrally joined with the yoke and project outwardly therefrom. Each of the wings has a leading edge and a trailing edge. The trailing edges of the wings are seamlessly integrated with the contoured trailing edge of the tail section. There is a plurality of securing devices disposed through the center body securing the slip-on hydrofoil to a cavitation plate.

In another embodiment, the current invention provides a hydrofoil. The hydrofoil comprises a yoke and a pair of wings. The yoke has a center body. There is a longitudinal channel defined by the center body. The longitudinal channel has oppositely positioned walls defining oppositely positioned slots therein. Each of the wings has a wing tip, a root, and a trailing edge. Each of the wings has a cross-sectional configuration of at least one true hydrofoil from the wing tip to the root. The pair of wings are joined to the yoke at the root. There is at least one non-invasive securing device for retaining said hydrofoil on a cavitation plate.

In yet another embodiment, the current invention provides a minimum cavitation, low-drag hydrofoil. The minimum cavitation, low-drag hydrofoil comprises a yoke and a pair of wings. The yoke includes a longitudinal channel and a tail section. The longitudinal channel has a pair of oppositely positioned slots disposed in oppositely positioned walls. The tail section integrally covers a portion of the longitudinal channel. Each of the wings has a wing tip, a root, and a trailing edge. Each of the wings has a cross-sectional configuration of at least one true hydrofoil from the wing tip to the root. Each wing has at least one angle of attack. The pair of wings are joined to the yoke at the root. There is a contoured trailing edge extending from the tail section and seamlessly integrated with the trailing edge of the wings. The contoured trailing edge on the tail section is a juncture of a contoured flow surface area and an upward sloping bottom. There is a drag reducing surface on the hydrofoil. There is at least one securing device for retaining said hydrofoil on a cavitation plate.

BRIEF DESCRIPTION OF THE DRAWINGS

FIG. 13 is a schematic of a representative example of a true hydrofoil shape.

DETAILED DESCRIPTION

Figure 1:
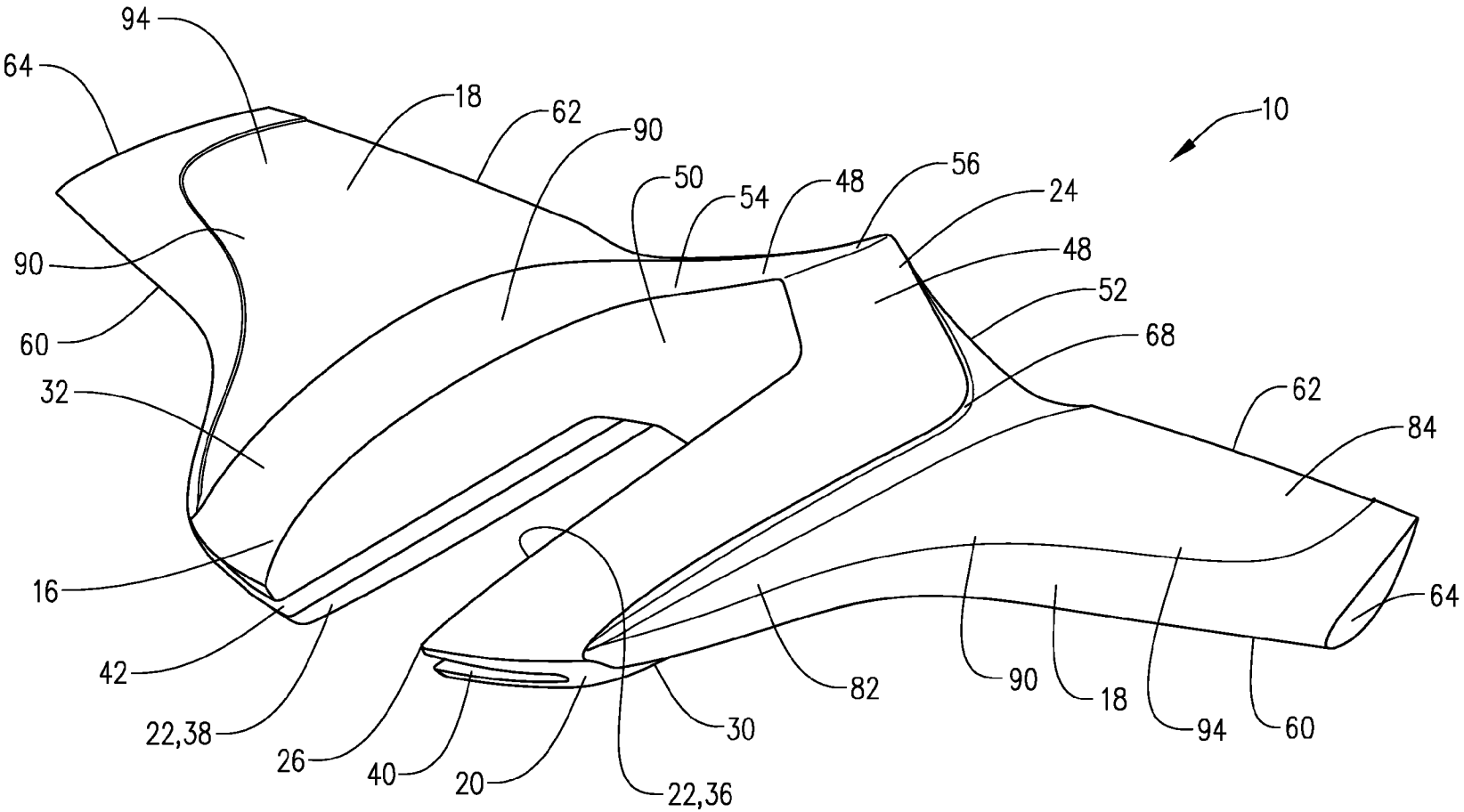
FIG. 1 is a front top perspective view.
Figure 2:
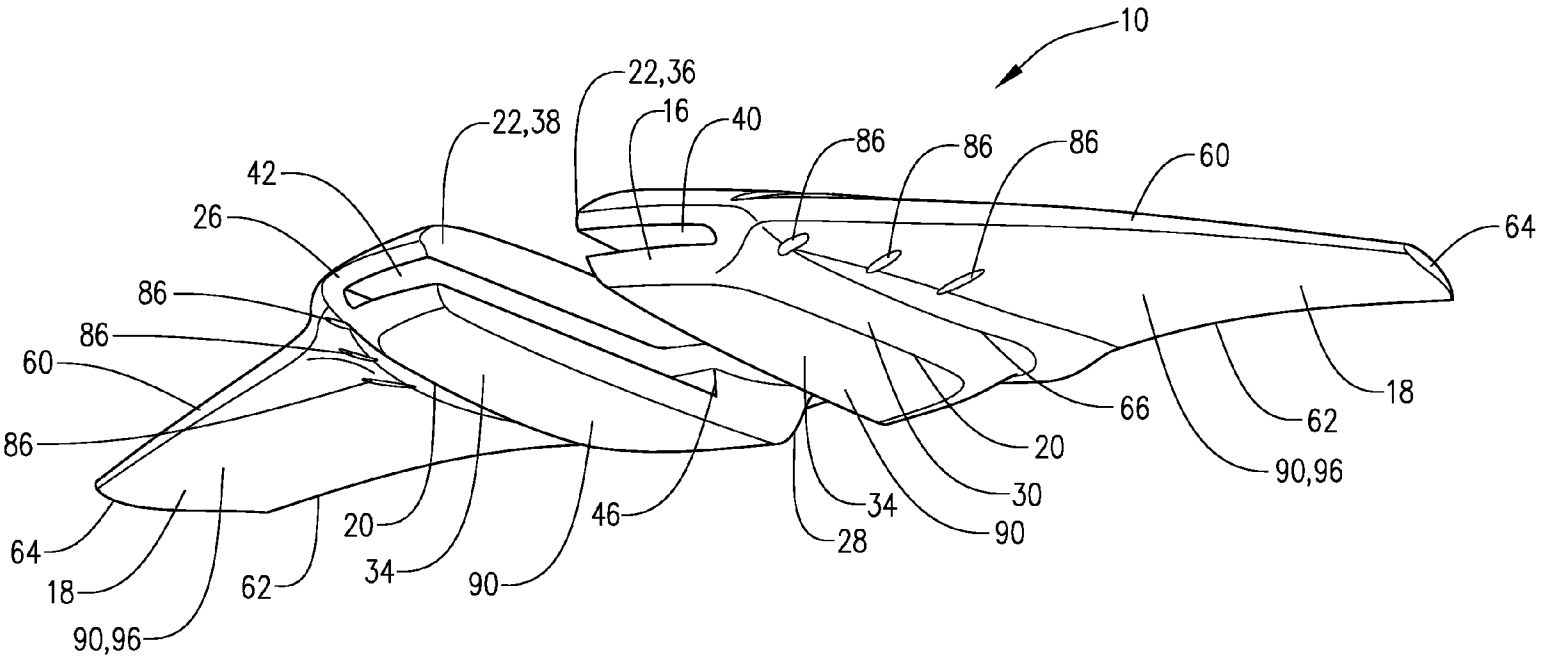
FIG. 2 is a front bottom perspective view.
Figure 3:
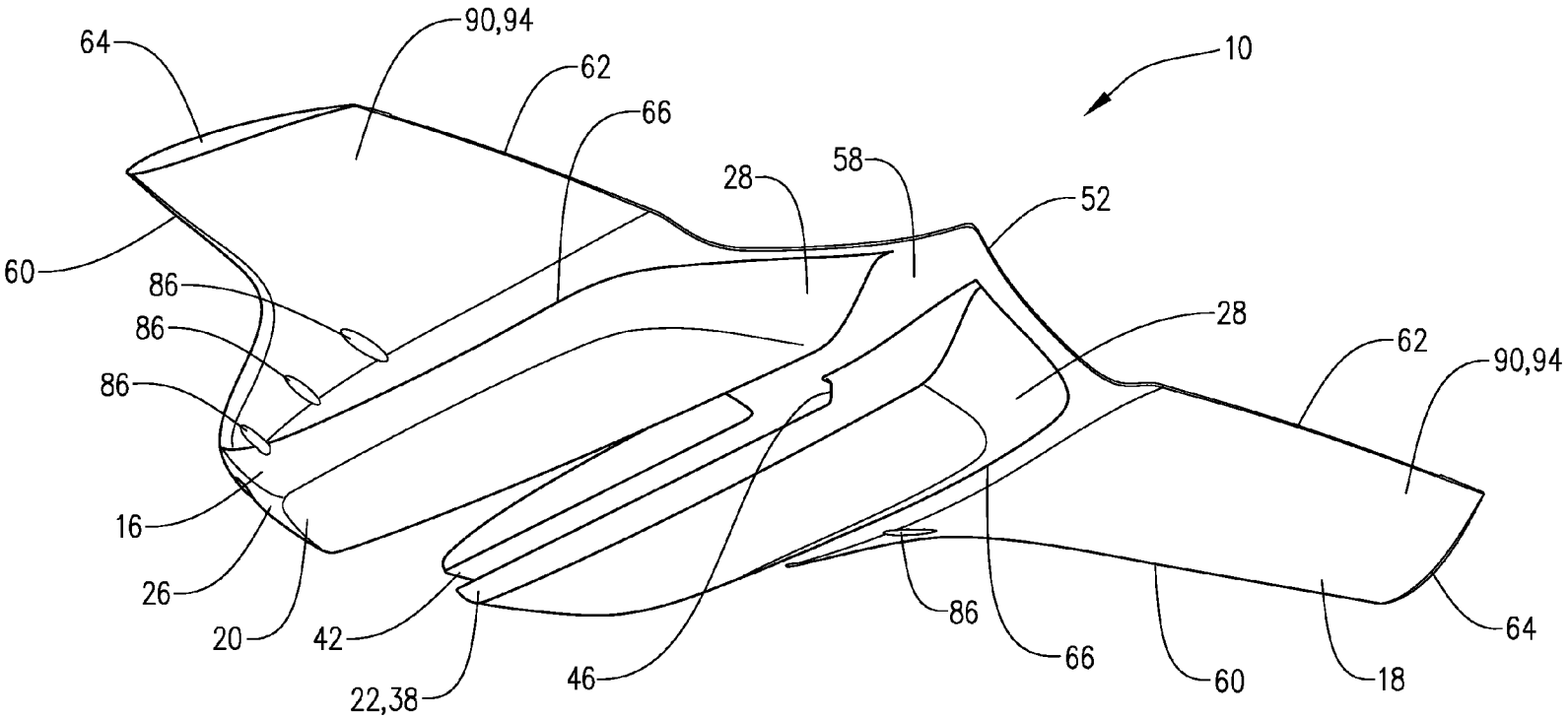
FIG. 3 is a back bottom perspective view.

Referring to FIGS. 1-14, the hydrofoil apparatus is illustrated and generally designated by the numeral 10. Hydrofoil 10 is designed as a slip-on hydrofoil having minimum cavitation with low-drag characteristics. Hydrofoil 10 will slip onto cavitation plate 12 of lower drive unit 14 of a boat motor (not shown). Hydrofoil 10 is the combination of yoke 16 and wings 18. Yoke 16 is designed to fit around cavitation plate 12 and lower drive unit 14 of a boat motor.

Regarding FIGS. 1-3, 5 and 9, yoke 16 includes center body 20, longitudinal channel 22, and tail section 24. Yoke 16 also includes front 26, aft 28, sides 30, top 32 and bottom 34 of center body 20. Front 26, aft 28 and sides 30 all have rounded edges transitioning to bottom 34. Additionally, front 26 and aft 28 are sloped towards sides 30, thereby reducing drag around yoke 16.

Yoke 16 centrally defines longitudinal channel 22 within center body 20. Longitudinal channel 22 opens to front 26 and aft 28. Longitudinal channel 22 has channel first side 36 and channel second side 38, which are oppositely positioned walls. Open-ended slots 40 and 42 are disposed in channel first and second sides 36 and 38, respectively. Open-ended slots 40 and 42 are oppositely positioned from each other. As illustrated, open-ended slots 40 and 42 are approximately centered on channel sides 36 and 38. However, open-ended slots 40 and 42 may be positioned above or below the depicted location by as much as about 25 percent without significant degradation to hydrofoil 10 performance. Open-ended slots 40 and 42 are sized to slip on cavitation plate 12 and around torque tab 44 affixed thereto.

Referring to FIGS. 2, 3, 9 and 14, open-ended slots 40 and 42 are capable of receiving cavitation plate 12. As illustrated, open-ended slots 40 and 42 extend along a substantial length of channel first and second sides 36 and 38, terminating near aft 28 of center body 20 at slot wall 46. Slot wall 46 provides a receiving block for cavitation plate 12 that prevents cavitation plate 12 from moving aftwardly in open-ended slots 40 and 42 once hydrofoil 10 is slipped thereon. Although not illustrated, yoke 16 and longitudinal channel 22 are optionally adjustable to facilitate placement of hydrofoil 10 on different boat motors and cavitation plates 12.

Extending from yoke 16 onto contoured flow surface area 48 of tail section 24 of hydrofoil 10 is yoke drag relief 50. Yoke drag relief 50 is wedge-like in its shape. Yoke drag relief 50 eliminates hydraulic impingement on hydrofoil 10 at the point where the water flow departs from cavitation plate 12 and lower drive unit 14 of a boat motor. Thus, yoke drag relief 50 reduces the drag acting upon hydrofoil 10.

Referring to FIGS. 1-6, tail section 24 is integrally formed with yoke 16 across top 32 and center body 20 towards aft 28. Tail section 24 provides the connective support structure for yoke 16. A portion of tail section 24 covers longitudinal channel 22. Tail section 24 terminates beyond aft 28 of yoke 16 at contoured trailing edge 52.

The portion of longitudinal channel 22 covered by tail section 24 is preferably about one-half of the total length of yoke 16 and tail section 24 combined, or less. As illustrated in FIGS. 1-6 and 9, a small portion of longitudinal channel 22 and open-ended slots 40 and 42 are covered by tail section 24.

Tail section 24 includes yoke drag relief 50. Yoke drag relief 50 provides for transition of fluid, such as water, from cavitation plate 12 and lower drive unit 14 of a boat motor over transition flow edge 54, and onto and along contoured flow surface area 48 and spine 56. Transition flow edge 54 is the transition point from yoke drag relief 50 and contoured flow surface area 48 and spine 56. Contoured flow surface area 48 and spine 56 provide water flow onto and over contoured trailing edge 52. Both contoured flow surface area 48 and spine 56 terminate at contoured trailing edge 52.

Extending from bottom 34 at aft 28 is upward sloping bottom 58 of tail section 24. Contoured flow surface area 48 and upward sloping bottom 58 join together to form contoured trailing edge 52. Contoured trailing edge 52 is the juncture of contoured flow surface area 48 and upward sloping bottom 58. As illustrated in FIGS. 1, 4, 6 and 9, contoured flow surface area 48 provides an upwardly angling flow direction as it approaches contoured trailing edge 52. Similarly, upward sloping bottom 58 provides an upwardly angling flow direction as it approaches contoured trailing edge 52. Upward sloping bottom 58 has a steeper upward slope than that of contoured flow surface area 48. The resulting flow of water, as it departs contoured trailing edge 52, has an overall reduction of turbulence, which in turn reduces the cavitation and drag imparted to hydrofoil 10.

As illustrated in FIGS. 1-8, wings 18 have leading edge 60, trailing edge 62, wing tip 64 and root 66. Wings are seamlessly and integrally joined with yoke 16 at root 66. In particular, wings are integrally joined with center body 20 at root 66 and form upper flow channel 68 where upper surface of wings 18 join top 32 of yoke 16. Upper flow channel 68 channels water in the transition zone between wing root 66 and yoke 16 towards aft 28 and tail section 24. To minimize drag from the separation of the water from trailing edge 62 and contoured trailing edge 52, trailing edge 62 and contoured trailing edge 52 are seamlessly integrated together. The seamless integration of trailing edge 62 and contoured trailing edge 52 provides for a low-drag release of the water from the hydrofoil tail section.

As illustrated in FIGS. 7, 10-12 and 13, wings 18 have cross-sectional shape 70 that is the configuration of a true hydrofoil. The configuration of a true hydrofoil is illustrated in FIG. 13. Non-limiting examples of true hydrofoils include hydrofoils having the designation of NACA 63-209, Eppler E817, Eppler E818, Eppler E836, Eppler 837, Eppler E838, Eppler E874, Eppler E904, Eppler E908, and Speers H105. Some of the decision parameters used to select the true hydrofoil are based upon the speed, lift, and drag characteristics for which the hydrofoil will be utilized. In one preferred embodiment, the Speers H105 hydrofoil shape satisfies all of the desired characteristics of lift and drag for the different speeds hydrofoil 10 is to operate.

Preferably, wings 18 continuously retain the cross-sectional configuration of the true hydrofoil from wing tip 64 through root 66, including a plurality of angles of attack, but at least one angle of attack. Alternatively, the true hydrofoil shape transitions from a first true hydrofoil shape to at least one other true hydrofoil shape for each angle of attack based upon the broad spectrum of performance parameters desired for hydrofoil 10.

Figure 10:
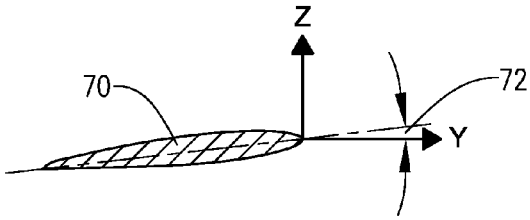
FIG. 10 is a section view taken along lines 10-10 of FIG. 7.
Figure 11:
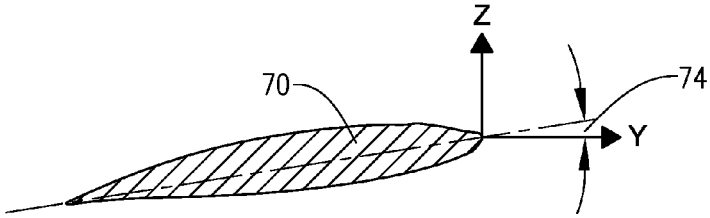
FIG. 11 is a section view taken along lines 11-11 of FIG. 7.
Figure 12:
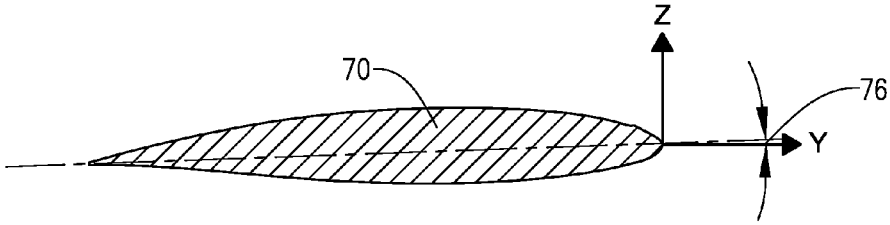
FIG. 12 is a section view taken along lines 12-12 of FIG. 7.
Figure 7:
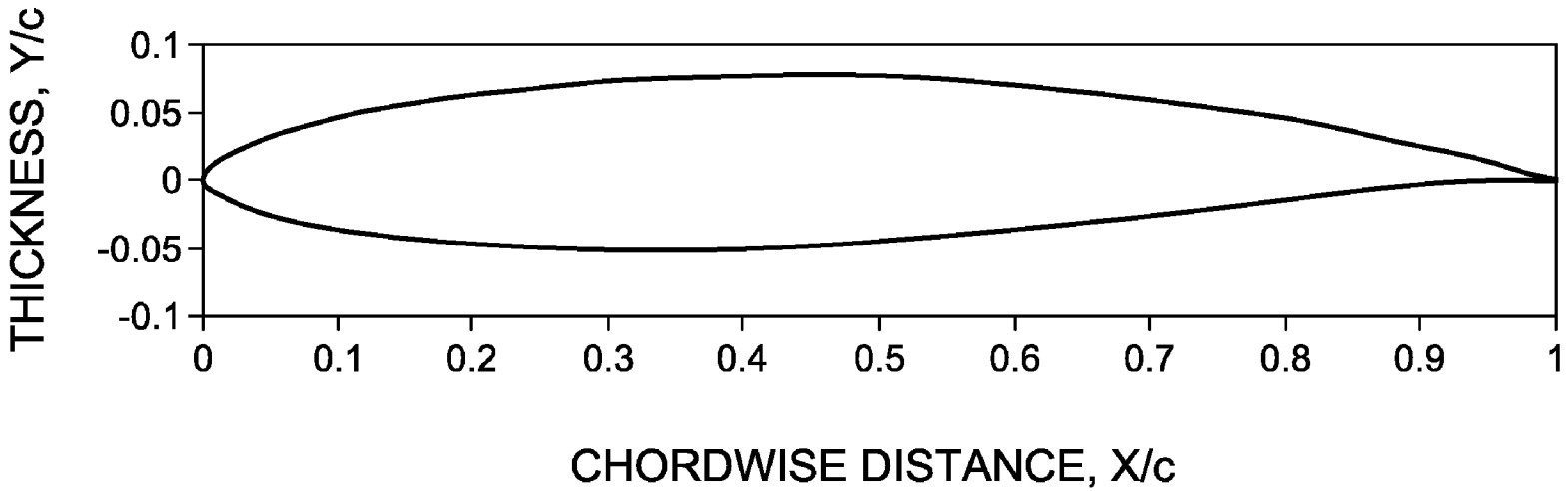
Figure 14:
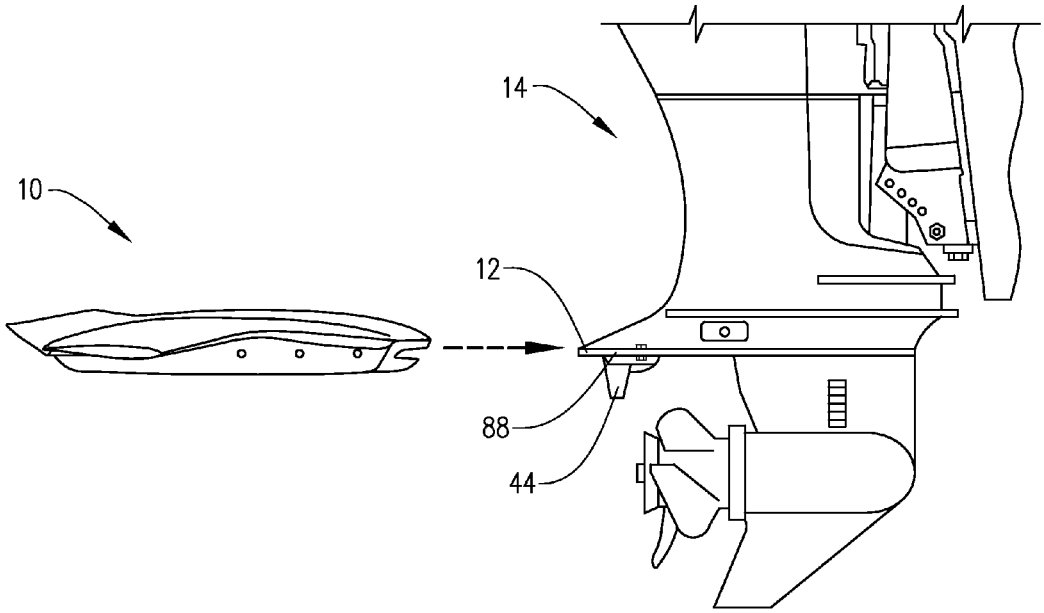
FIG. 14 is a side view of a hydrofoil positioned to slip onto the lower drive unit of a boat motor.

As representatively illustrated in FIGS. 7 and 10-12, wings 18 have at least three angles of attack: first angle of attack 72, second angle of attack 74 and third angle of attack 76. FIG. 10 illustrates cross-sectional shape 70 from a section of wing 18 taken near wing tip 64 having first angle of attack 72. FIG. 11 illustrates cross-sectional shape 70 from a section of wing 18 taken along second angle of attack 74. In addition, FIG. 12 illustrates cross-sectional shape 70 from a section of wing 18 taken along third angle of attack 76. FIGS. 10-12 include the reference coordinates in order to illustrate the angle of attack.

Wings 18 in the configuration of a true hydrofoil provide for at least one lifting segment 78 having at least one angle of attack. Preferably, wings 18 have a plurality of lifting segments 78, whereby each lifting segment 78 has an angle of attack that is separate from the angle of attack of the lifting segment 78 immediately proximate thereto. Thus, wings 18 preferably have a plurality of angles of attack.

Figure 7:
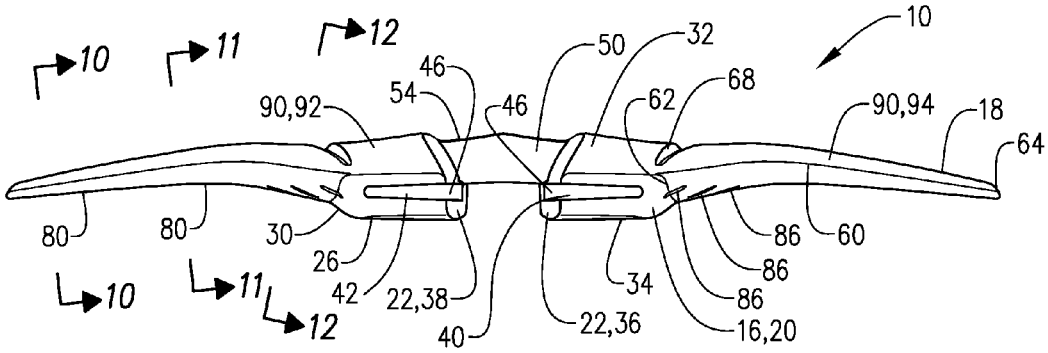
FIG. 7 is a front landscape view.
Figure 8:
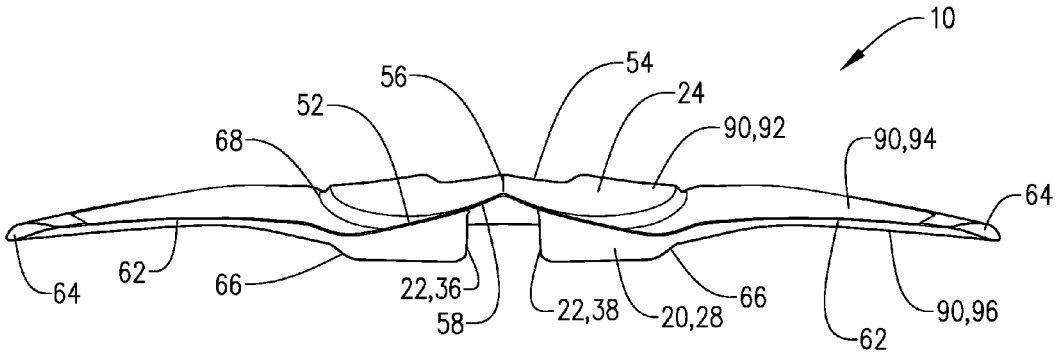
FIG. 8 is a back landscape view

The embodiment in FIGS. 7 and 10-12, representatively illustrates that wings 18 have at least angles of attack 72, 74 and 76, thereby providing low-to-medium-to-high speed lift characteristics. Having first, second and third angles of attack 72, 74 and 76 allows hydrofoil 10 to provide a broad range lift capacity. As illustrated in FIGS. 7 and 10, first angle of attack 72 is continuous along the outer section of wing 18, second angle of attack 74 is continuous along the midsection of wing 18, and third angle of attack 76 is continuous along the inner section of wing 18. However, wing 18 may operate with one, two, or more angles of attack.

Referring to the embodiment in FIGS. 7 and 10-12, second angle of attack 74 is the steepest angle of attack on wing 18. Thus, second angle of attack provides the maximum lift performance of hydrofoil 10 when the water flowing across wing 18 is flowing at low speeds. First angle of attack 72 is flatter than second angle of attack 74 and provides maximum lift performance of hydrofoil 10 when water is flowing across wing 18 at medium-to-high speeds. Third angle of attack 76 is flatter than first and second angles of attack 72 and 74. Thus, third angle of attack 76 provides the maximum lift performance of hydrofoil 10 when water is flowing across wing 18 at high speeds, as well as providing some lift of yoke 16 at lower speeds. Although wings 18 have angles of attack providing maximum lift for differing speeds of hydrofoil 10, each angle of attack provides lift at speeds outside of the particularly identified angle of attack.

Illustrated in FIG. 7, when viewed continuously from wing tip 64 to root 66, there are at least two angle of attack transition points 80. Angle of attack transition points 80 comprise a plurality of incremental angles of attack, or wing twist, wherein each retains the cross-sectional configuration of the true hydrofoil. Thus, angle of attack 72 transitions to angle of attack 74 through angle of attack transition point 80, and angle of attack 74 transitions to angle of attack 76 through another angle of attack transition point 80. Accordingly, wing 18 defines a plurality of angles of attack from wing tip 64 to root 66. Using the example of the Speers H105 hydrofoil, the cross-sectional area will remain that of the 11105 shape. This provides for a broad range of lift capacity across a broad range of speeds.

The embodiment illustrated in FIGS. 7 and 10 shows an angle of attack 72 of about 0.5 degrees. This same embodiment, illustrated in FIGS. 7 and 11, shows an angle of attack 74 of about 2.5 degrees. And, this same embodiment, illustrated in FIGS. 7 and 12, shows an angle of attack 76 of about zero (0) degrees. A maximum range for angle of attack 72 is between about zero (0) degrees and about 5 degrees. A maximum range for angle of attack 74 is between about zero (0) degrees and about 20 degrees. A maximum range for angle of attack 76 is between about zero (0) degrees and 10 degrees.

As illustrated in FIGS. 1-5, wings 18 have a swept-back configuration. Near root 66, wings 18 have forward section 82 seamlessly extending from yoke 16. Forward section 82 sharply sweeps back from yoke 16 towards aft 28, and transitions into outer section 84 near transition point 80.

Figure 5:
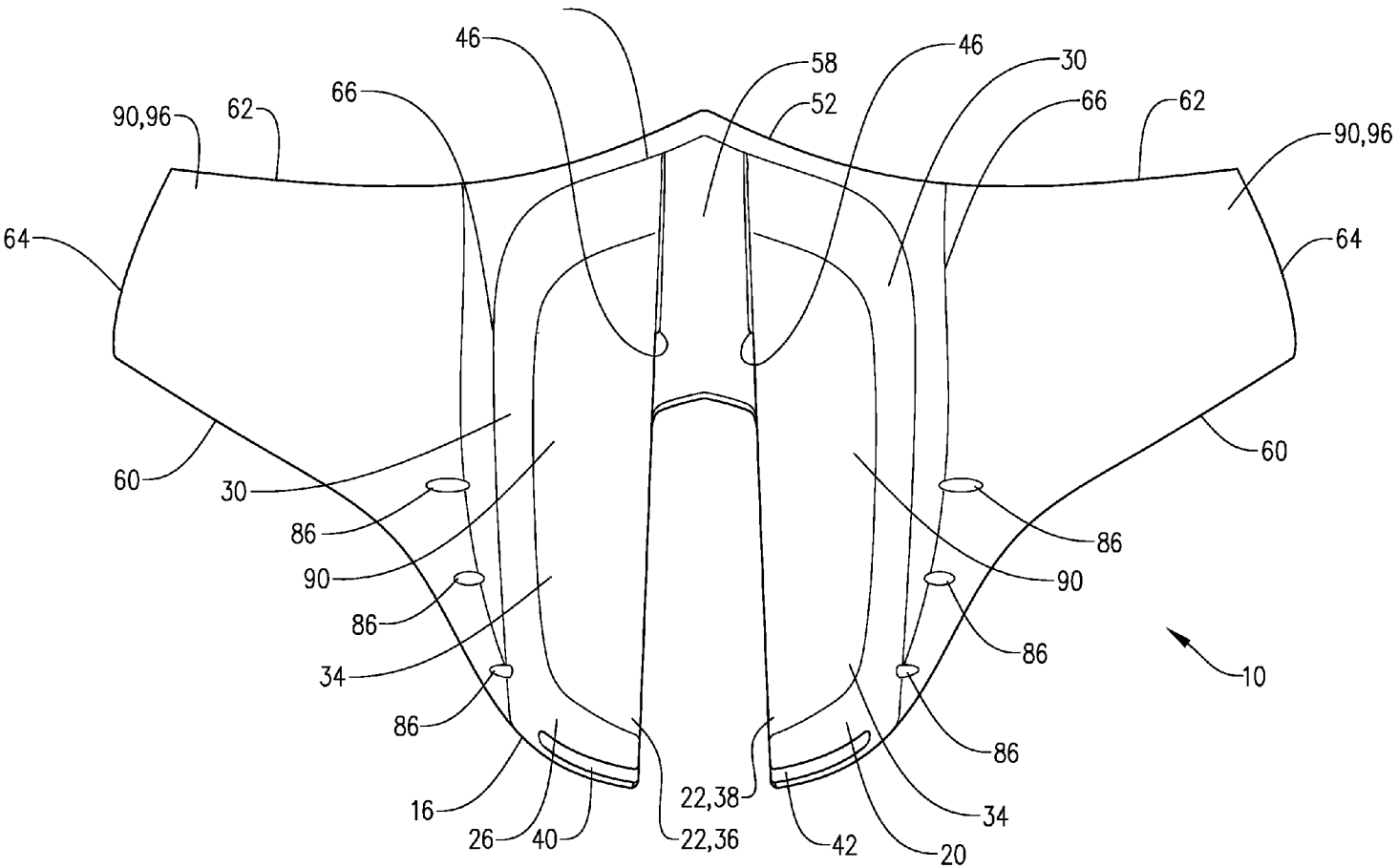
FIG. 5 is bottom view.
Figure 6:
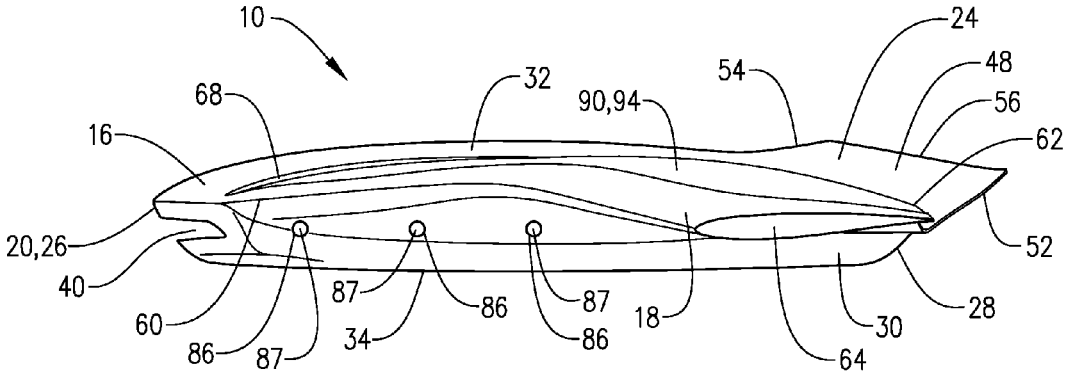
FIG. 6 is a side landscape view.
Figure 9:
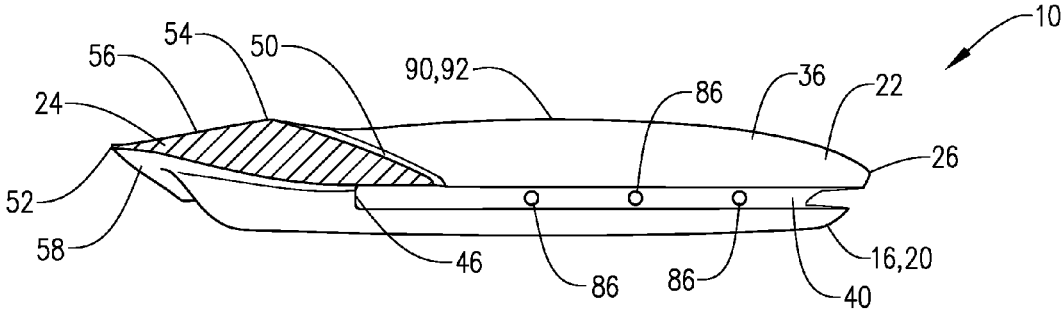
FIG. 9 is a section view taken along lines 9-9 of FIG. 4.
Figure 15A:
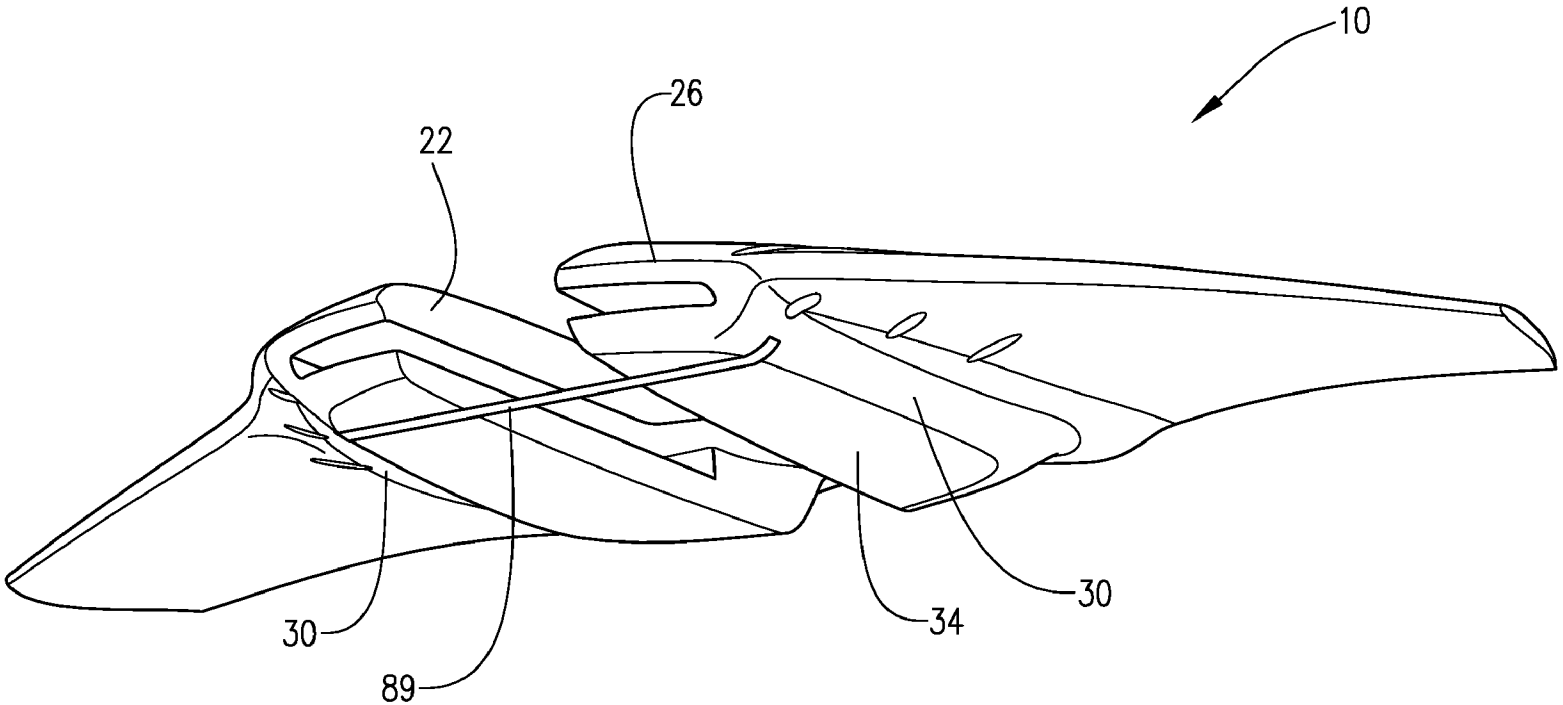
FIGS. 15A-D are schematic views of an additional connective device on the hydrofoil.
Figure 15C:
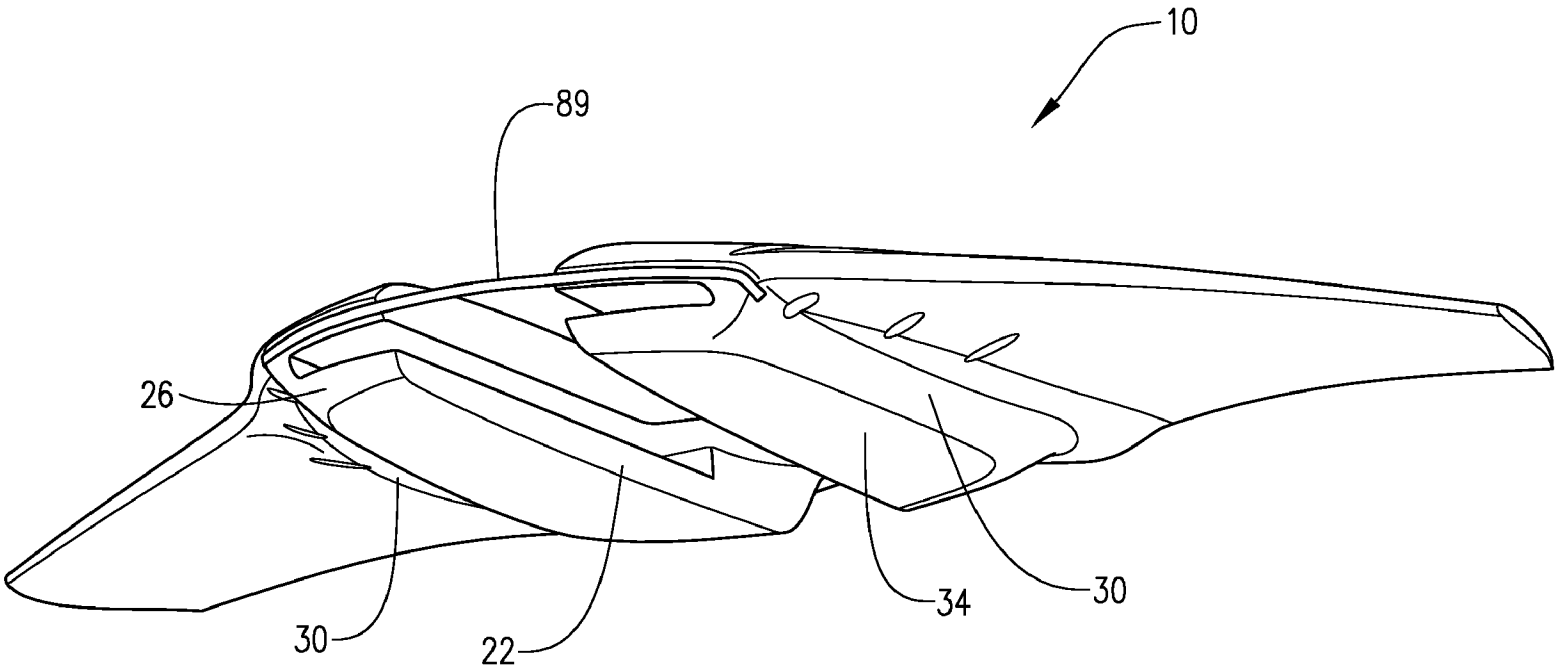
Figure 15B:
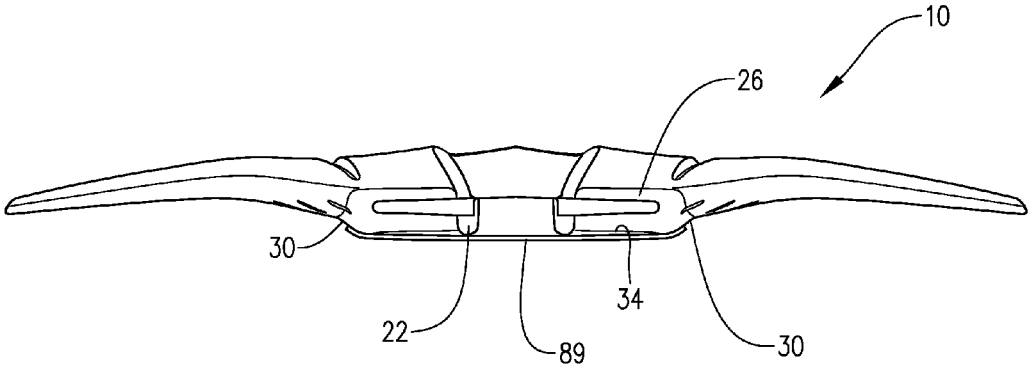
Figure 15D:
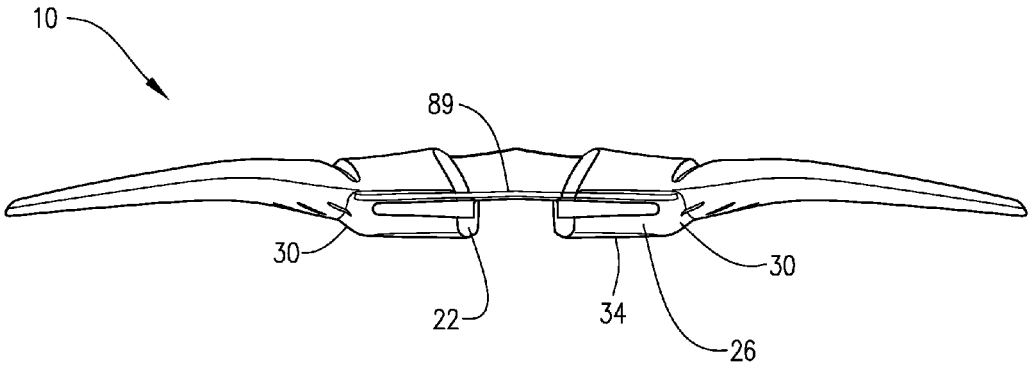

Yoke 16 is secured to cavitation plate 12 with securing devices (not shown), which may be setscrews or other similar low-profile devices. As illustrated in FIGS. 5, 6 and 9, a plurality of threaded holes 86 are disposed through center body 20 of yoke 16. Threaded holes 86 have threads 87 disposed therein. Threaded holes 86 are positioned to align with edge 88 of cavitation plate 12 when yoke 16 is positioned thereon. Once yoke 16 is positioned on cavitation plate 12, the securing devices are tightened until the yoke is securely affixed to edge 88. Preferably, securing devices compressively engage edge 88 of cavitation plate 12. By using compressive force to secure yoke 16, the securing devices are non-invasively securing yoke 16 to cavitation plate 12. If additional and/or supplement support is desired, a low-profile retention strap 89, or another connective device (not shown), may be added, as illustrated in FIGS. 15A-D. If used, low-profile retention strap 89 is connected between sides 30, across front 26 and longitudinal channel 22, across bottom 34 and longitudinal channel 22, or a combination thereof These two different combinations are illustrated in FIGS. 15A and 15B, and in FIGS. 15C and 15D, respectively. Other connective devices may also be utilized to secure hydrofoil 10 to cavitation plate 12, such as, but not limited to devices positioned within recessed attachment points (not shown) on yoke 16.

Figure 4A:
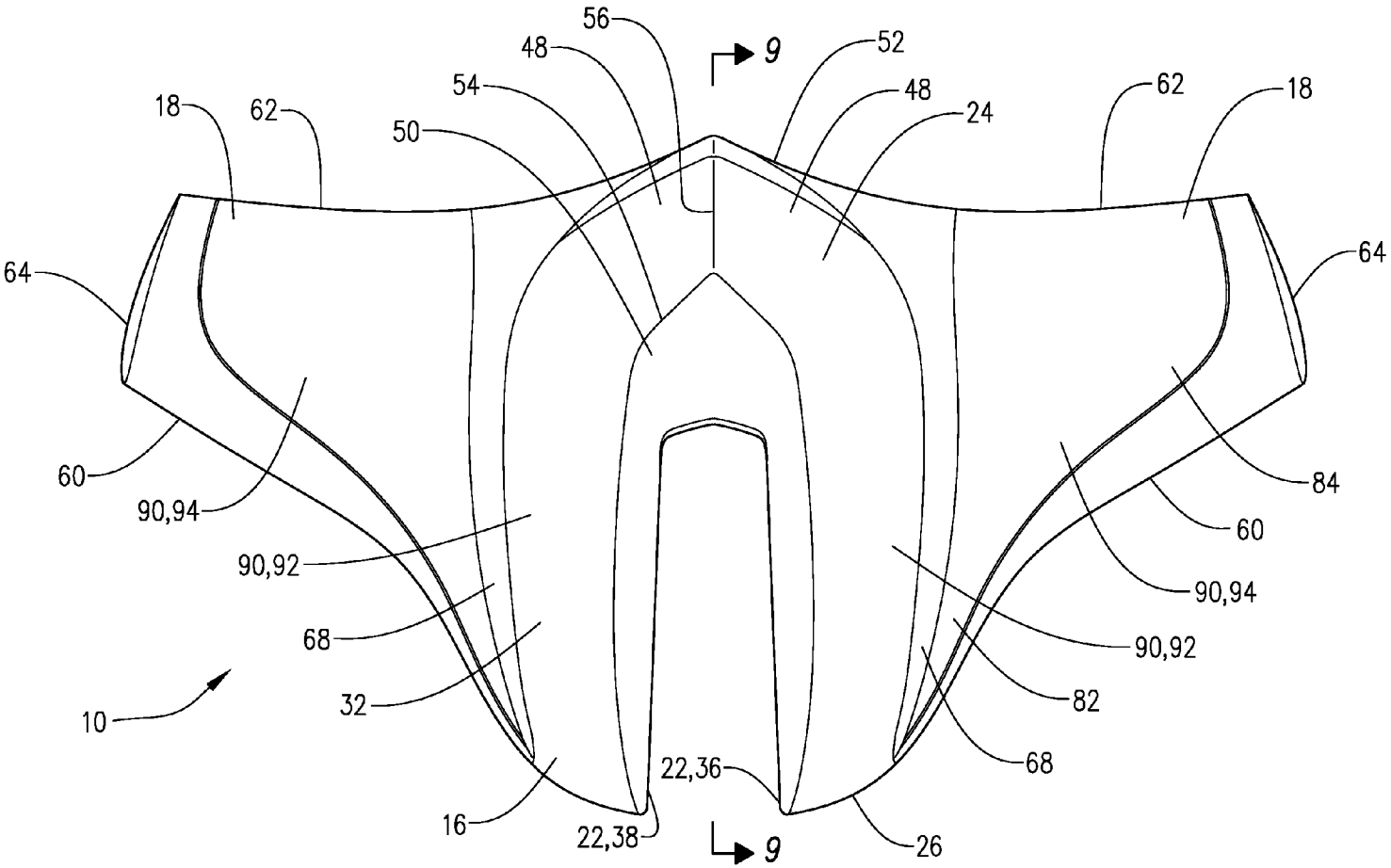
FIGS. 4A and 4B are plan views depicting a hydrofoil without and with a drag reducing surface respectively.
Figure 4:
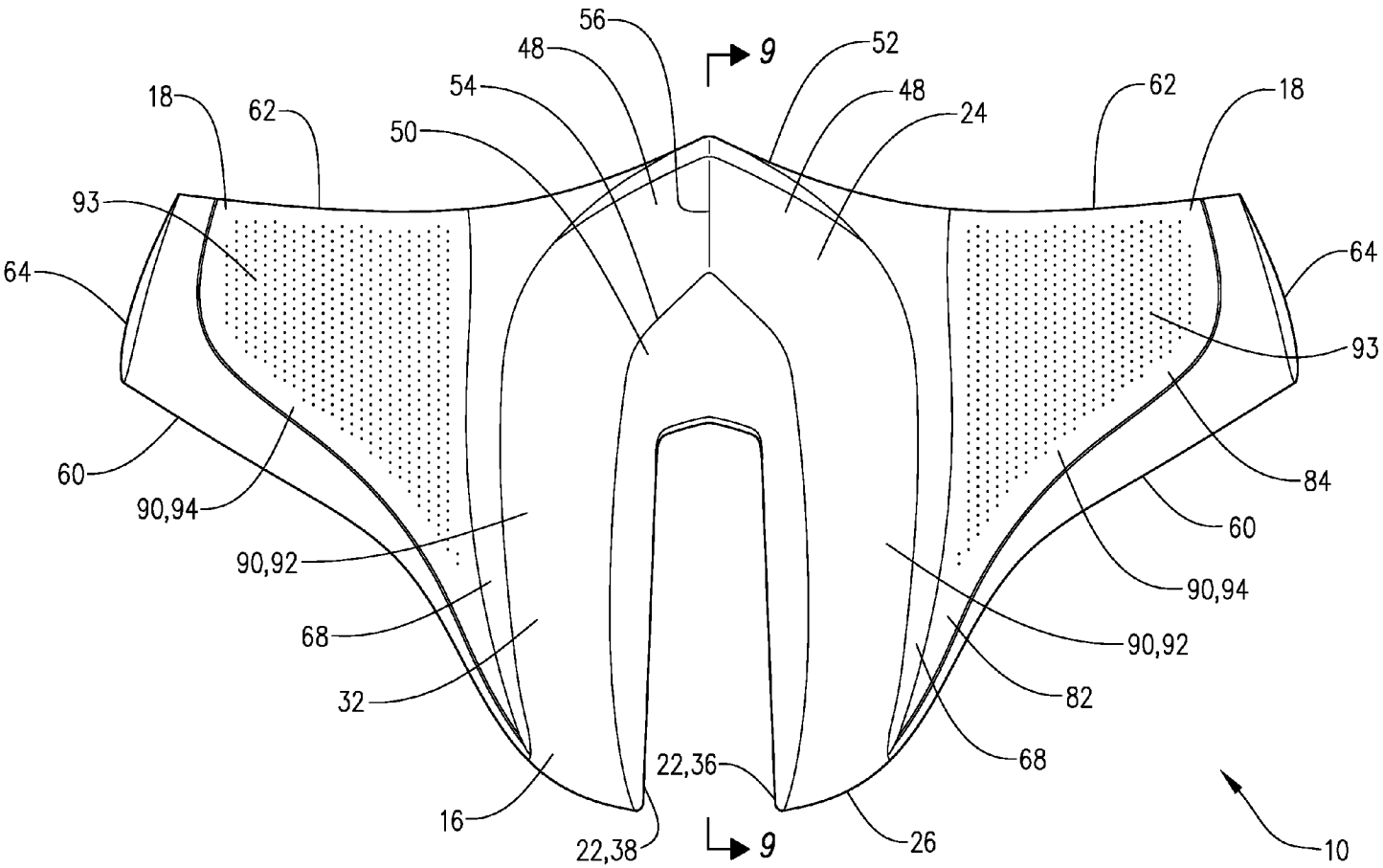

To reduce drag, exposed outer surface 90 of hydrofoil 10 is textured. The preferred texturing reduces the magnitude of turbulent separation of the water from exposed outer surface 90. By reducing the magnitude of the turbulent separation, the localized drag hydrofoil 10 is subjected to is also reduced. In one embodiment, depicted in FIG. 4B, exposed outer surface 90 is comprised of a plurality of extremely small outward projections 93 that have varying height and placement across exposed outer surface 90, thereby creating the drag reducing surface. This approach is analogous to the denticles found on sharkskin. Preferably, the drag reducing texture of exposed outer surface 90 is formed thereon, but it may also be applied thereto.

If desired, the entire exposed outer surface 90 of hydrofoil 10 may have the drag reducing texture. Alternatively, only particular segments of hydrofoil 10 may have the drag reducing texture. For example, the drag reducing texture on exposed outer surface 90 may be limited to upper surface 92 of tail section 24 and to wing upper surface 94 of wings 18.

During performance of a boat having hydrofoil 10 installed thereon, different sections of hydrofoil 10 operate to provide lift. For example, for a boat at a full-stop condition through low speeds, the lifting body section of hydrofoil 10 at angles of attack 74 and 76 provide increased lift. As that same boat accelerates, the lifting body sections of hydrofoil 10 at angles of attack 72 and 74 lift hydrofoil 10 in the water. The result is that the lifting body sections of hydrofoil 10 at angles of attack 72 and 74 provide for stabilization and lift at higher speeds. The lift provided by angle of attack 72 near wing tip 64 begins to carry the majority of the lifting while reducing the overall drag on hydrofoil 10 as the speeds increase.

In operation, water flowing over hydrofoil 10 transitions between laminar and turbulent. Turbulent flow creates drag and increases the profile drag, thereby reducing the performance of hydrofoil 10. By using wings 18 with a cross-sectional shape configuration of the true hydrofoil, such as the Speers H105, the transition phase of the laminar-to-turbulent is such that the overall amount of laminar flow remains constant across wings 18 as the speed varies. That is, as the speed increases, the laminar-to-turbulent transition on wing upper surface 94 moves toward leading edge 60, while the laminar-to-turbulent transition on wing lower surface 96 moves toward trailing edge 62. This action keeps cavitation to a minimum and constant level, thereby minimizing and/or reducing drag. The addition of drag reducing texture to exposed outer surface 90 reduces the impact of the turbulent flow aft of the laminar-to-turbulent transition on wing upper surface 94, and/or wing lower surface 96. Thus, the localized drag and the overall drag are reduced, resulting in increased performance.

Other embodiments of the current invention will be apparent to those skilled in the art from a consideration of this specification or practice of the invention disclosed herein. Thus, the foregoing specification is considered merely exemplary of the current invention with the true scope thereof being defined by the following claims.

What is claimed is:

1. A slip-on hydrofoil comprising:

a yoke including:

a center body defining a longitudinal channel therein, wherein said longitudinal channel has a first and second side and is open to a front of said center body;

a pair of open-ended slots oppositely disposed in each of said channel sides and extending along a substantial length of said sides, wherein said open-ended slots are capable of receiving a cavitation plate of a boat motor;

a tail section integrally formed with said center body and covering a portion of said longitudinal channel;

a contoured trailing edge defined by said tail section, said contoured trailing edge angles upwardly into a trailing edge peak;

a pair of wings integrally joined with said yoke and projecting outwardly therefrom, said pair of wings having a leading edge and a trailing edge, wherein said trailing edge is seamlessly integrated with said contoured trailing edge of said tail section;

a plurality of securing devices disposed through said center body securing said slip-on hydrofoil to a cavitation plate.

2. The slip-on hydrofoil of claim 1, wherein said portion of said longitudinal channel covered by said tail section is less than one-half of a length of said longitudinal channel.

3. The slip-on hydrofoil of claim 1, wherein said slots have sufficient size to slip-on and around a torque tab affixed to said cavitation plate.

4. The slip-on hydrofoil of claim 1, wherein said wings have a tip and a root, and said wings have a continuous cross-sectional shape, said continuous cross-sectional shape having the configuration of a true hydrofoil.

5. The slip-on hydrofoil of claim 4, wherein said wings have a plurality of angles of attack, wherein said continuous cross-sectional shape maintains the configuration of a true hydrofoil continuously therethrough and through said plurality of angles of attack.

6. The slip-on hydrofoil of claim 5, wherein said true hydrofoil is selected from the group consisting of hydrofoils having a designation of NACA 63-209, Eppler E817, Eppler E818, Eppler E836, Eppler 837, Eppler E838, Eppler E874, Eppler E904, Eppler E908, and Speers H105.

7. The slip-on hydrofoil of claim 1, wherein said wings have at least three angles of attack.

8. The slip-on hydrofoil of claim 7, wherein said angles of attack have a continuous cross-sectional shape therethrough and said continuous cross-sectional shape is in the configuration of a H105 hydrofoil.

9. The slip-on hydrofoil of claim 1, wherein said channel is adjustable, said channel being able to slip-on and be secured to said cavitation plates having different sizes.

10. The slip-on hydrofoil of claim 1, wherein said securing devices compressively engage an edge of said cavitation plate.

11. The slip-on hydrofoil of claim 1, wherein said hydrofoil has an exposed outer surface defining a low-drag surface finish on substantially all of said exposed outer surface.

12. The slip-on hydrofoil of claim 1, further comprising a connective device, said connective device supplementing said securing device to secure said slip-on hydrofoil to a cavitation plate.

13. A hydrofoil comprising:

a yoke having a center body;

a longitudinal channel defined by said center body, said longitudinal channel having oppositely positioned walls defining oppositely positioned slots therein; and a pair of wings having a wing tip, a root, and a trailing edge, each said wing having a cross-sectional configuration of at least one true hydrofoil from said wing tip to said root, wherein said pair of wings are joined to said yoke at said root;

a tail section integrally formed with said center body, said tail section defining a contoured trailing edge terminating into a trailing edge peak wherein said contoured trailing edge seamlessly integrates with said trailing edge of said wings; and at least one non-invasive securing device for retaining said hydrofoil on a cavitation plate.

14. The hydrofoil of claim 13, wherein said tail section covers a portion of said longitudinal channel, and wherein said tail section defines a low-drag surface thereon.

15. The hydrofoil of claim 14, wherein said portion of said longitudinal channel covered by said center body is less than one-half of a length of said longitudinal channel.

16. The hydrofoil of claim 13, wherein said contoured trailing edge has an upward sloping top and bottom, wherein said upward sloping bottom is steeper than said top, thereby providing for less turbulent departure of water flowing over said hydrofoil from said contoured trailing and reducing drag imparted to said hydrofoil.

17. The hydrofoil of claim 13, wherein said true hydrofoil is selected from the group consisting of hydrofoils having a designation of NACA 63-209, Eppler E817, Eppler E818, Eppler E836, Eppler 837, Eppler E838, Eppler E874, Eppler E904, Eppler E908, and Speers H105.

18. The hydrofoil of claim 13, wherein said slots are capable of receiving a cavitation plate of a boat motor and are sized to slip-on and around a torque tab affixed to said cavitation plate.

19. The hydrofoil of claim 13, wherein said wings have a first angle of attack, said first angle of attack being positioned outwardly on said wing.

20. The hydrofoil of claim 19, wherein said wings have a second angle of attack, said second angle of attack positioned closer to said root than said first angle of attack.

21. The hydrofoil of claim 20, wherein said wings have a third angle of attack, said third angle of attack positioned closer to said root than said second angle of attack.

22. The hydrofoil of claim 13, wherein said pair of wings have a plurality of lifting segments whereby each said lifting segment has an angle of attack separate from the angle of attack of said lifting segment immediately proximate thereto.

23. The hydrofoil of claim 13, wherein said yoke is adjustable, thereby allowing said center body to receive differently sized cavitation plates.

24. The hydrofoil of claim 14, wherein said non-invasive securing device compressively secures said center body to an edge of said cavitation plate.

25. The hydrofoil of claim 22, further comprising an additional securing device to supplement said non-invasive securing device.

26. The hydrofoil of claim 22, where the true hydrofoil shape includes at least two true hydrofoil shapes.

27. A minimum cavitation, low-drag hydrofoil comprising:

a yoke including a longitudinal channel and a tail section, wherein said longitudinal channel has a pair of oppositely positioned slots disposed in oppositely positioned walls, wherein said tail section integrally covers a portion of said longitudinal channel;

a pair of wings having a wing tip, a root, and a trailing edge, each said wing having a cross-sectional configuration of at least one true hydrofoil from said wing tip to said root, and each wing having at least one angle of attack, wherein said pair of wings are joined to said yoke at said root;

a contoured trailing edge extending from said tail section and seamlessly integrated with said trailing edge of said wings, wherein said contoured trailing edge on said tail section is a juncture of a contoured flow surface area and an upward sloping bottom;

a drag reducing surface; and at least one securing device for retaining said hydrofoil on a cavitation plate.

28. The minimum cavitation, low-drag hydrofoil of claim 27, wherein said slots are capable of receiving a cavitation plate of a boat motor and are sized to slip-on and around a torque tab affixed to said cavitation plate.

29. The minimum cavitation, low-drag hydrofoil of claim 27, wherein said drag reducing surface comprises of a plurality of small outward projections, said plurality of small projections varying across said drag reducing surface.

30. The minimum cavitation, low-drag hydrofoil of claim 27, further comprising a second angle of attack.

31. The minimum cavitation, low-drag hydrofoil of claim 30, wherein said first angle of attack is designed to provide lift to said hydrofoil at medium-to-high-speeds.

32. The minimum cavitation, low-drag hydrofoil of claim 30, wherein said second angle of attack is designed to provide lift to said hydrofoil at low-speeds.

33. The minimum cavitation, low-drag hydrofoil of claim 30, wherein said first angle of attack is closer to said wing tip than said second angle of attack.

34. The minimum cavitation, low-drag hydrofoil of claim 30, further comprising an angle of attack transition point positioned between said first and second angles of attack, wherein said angle of attack transition point has a plurality of angles of attack proximate to each other.

35. The minimum cavitation, low-drag hydrofoil of claim 27, wherein said true hydrofoil is selected from the group consisting of hydrofoils having a designation of NACA 63-209, Eppler E817, Eppler E818, Eppler E836, Eppler 837, Eppler E838, Eppler E874, Eppler E904, Eppler E908, and Speers H105.

36. The minimum cavitation, low-drag hydrofoil of claim 27, wherein said wings have a swept configuration.

37. The minimum cavitation, low-drag hydrofoil of claim 27, wherein said center body is adjustable, thereby allowing said center body to receive differently sized cavitation plates.

38. The minimum cavitation, low-drag hydrofoil of claim 27, wherein said securing device is non-invasive, thereby not damaging said cavitation plate.

39. The minimum cavitation, low-drag hydrofoil of claim 38, wherein said securing device compressively secures said center body to an edge of said cavitation plate.

40. The minimum cavitation, low-drag hydrofoil of claim 38, further comprising an additional securing device to supplement said securing device, wherein said additional securing device locks said center body about said cavitation plate.

41. The minimum cavitation, low-drag hydrofoil of claim 27, wherein the true hydrofoil shape includes at least two true hydrofoil shapes.

* * * * *